US006964241B1

(12) United States Patent
Krebs

(10) Patent No.: US 6,964,241 B1
(45) Date of Patent: Nov. 15, 2005

(54) PORTABLE MOORING DEVICE FOR SMALL WATERCRAFT

(76) Inventor: Arthur D. Krebs, 825 Mountain Oak Dr., Strafford, MO (US) 65757

( * ) Notice: Subject to any disclaimer, the term of this patent is extended or adjusted under 35 U.S.C. 154(b) by 44 days.

(21) Appl. No.: 10/872,088

(22) Filed: Jun. 21, 2004

Related U.S. Application Data

(60) Provisional application No. 60/490,457, filed on Jul. 28, 2003.

(51) Int. Cl.[7] ..... B63B 21/00
(52) U.S. Cl. ..... 114/230.1; 405/7
(58) Field of Search ..... 114/44–48, 219, 114/230.1; 405/1, 3, 7; 280/414.1

(56) References Cited

U.S. PATENT DOCUMENTS 3,083,986 A * 4/1963 Moody et al. ..... 280/414.1
3,587,874 A 6/1971 Graf
5,067,428 A * 11/1991 Dickerson et al. ..... 405/1
RE33,930 E * 5/1992 Ardent ..... 269/296
5,259,694 A 11/1993 Byrne
5,267,811 A 12/1993 Evans
5,290,124 A 3/1994 Pavlescak
5,449,247 A 9/1995 Smith
5,460,112 A 10/1995 Travioli
5,477,802 A 12/1995 Laue
5,727,920 A * 3/1998 Hull et al. ..... 414/476
5,961,139 A * 10/1999 Nichols, II ..... 280/414.1
6,592,291 B2 7/2003 Foxwell
6,644,231 B2 * 11/2003 Crifase et al. ..... 114/219

* cited by examiner

*Primary Examiner*—Andrew D. Wright
(74) *Attorney, Agent, or Firm*—Donald R. Schoonover

(57) ABSTRACT

A portable mooring device for a small watercraft includes frame means having a pair of opposing side members and a plurality of crossbar members that are assemblable and adjustable by releasably securing telescopic engagements therebetween with removable pins, watercraft-seating means having shoe and support elements that are assemblable and adjustable by releasably securing telescopic engagements therebetween and the watercraft-seating means to the frame means with removable pins, and securing means having a tongue mechanism with a winch wherein the securing means is assemblable and adjustable by releasably securing telescopic engagements thereof and by releasably securing the securing means to the frame means with removable pins. The portable mooring device is easily disassemblable by simply removing all of the removable pins. A method of mooring a small watercraft is also disclosed.

12 Claims, 4 Drawing Sheets

10
171
151
141
145
147
143
149
105
107
119
117
111
115
113
117
17
109
132

73
27
31
71
128
69
123
125
73
61
13
47
51
69
71
21
25
23
45
35
71
73
69
121
73
65
55
71
153
37
15
153
57
83
81
94
59
69
94
39
33
71
29
73
63
53
49
69
73

PORTABLE MOORING DEVICE FOR SMALL WATERCRAFT

CROSS-REFERENCE TO RELATED APPLICATIONS

This application is based on Provisional Patent Application No. 60/490,457, filed Jul. 28, 2003.

BACKGROUND OF THE INVENTION

1. Field of the Invention

The present invention is related to small watercraft and more particularly, without limitation, to docking equipment for small watercraft.

2. Description of the Related Art

Small watercraft are commonly used by a multitude of people for a variety of purposes including for pleasure, such as boat racing and water skiing, and for recreation, such as fishing or simply cruising along a lake or waterway enjoying the scenery. One of the complications encountered by users of small watercraft occurs during those intervals when the watercraft is not in use and there are no docking facilities for safely securing the watercraft along a shoreline.

For example, if watercraft users are relaxing and eating at a campground along a waterway where there are no docking facilities or only limited docking facilities that have already been taken by other campers, they may be forced to tie their watercraft to a stake driven in the bank of the waterway, or other such makeshift arrangement. Such a procedure would obviously expose the watercraft to undesirable and potentially damaging random and repeated contact with the bank and/or the waterway bottom along the bank of the waterway, such as rocks, etc., which could easily mar or damage the smooth finished surface of the watercraft. This is cause for serious concern because an investment in a small pleasure or fishing boat can range from ten to forty thousand dollars, and fiberglass and paint repairs of watercraft can be very costly. Sometimes, old tires or carpet are left along waterways that can be used to provide some protection for temporarily moored watercraft where docking facilities are unavailable. Unquestionably, such makeshift padding constitutes unsightly clutter and debris, thereby destroying what might otherwise be a pleasing and aesthetic landscape.

The only other alternative that may be available for temporarily mooring a small watercraft is to put the watercraft back on a trailer and pull it completely out of the water; that is, if a trailer is available at that site and if a ramping area is available for accomplishing that objective, and if space is available to park the boat after it has been pulled out of the water. Unfortunately, trailering a boat can be time consuming and a hassle. As a result, even if trailering is a possibility, the stake and rope method may be used to avoid the time and hassle of trailering, which often results in needless and costly damage.

What is needed is a portable, lightweight mooring device for a small watercraft.

SUMMARY OF THE INVENTION

The improvements of the portable mooring device for a small watercraft of the present invention include frame means having a pair of opposing side members and a plurality of crossbar members wherein the frame means is assemblable by releasably securing telescopic engagements between the crossbar members and the pair of opposing side members with one or more pins; watercraft-seating means having shoe and support elements wherein the watercraft-seating means is assemblable by releasably securing telescopic engagements between the support elements and between the watercraft-seating means and the frame means with one or more pins; and securing means having a plurality of eye-hooks, for securing the portable mooring device to one or more land objects, and having a tongue mechanism having a first tongue portion with a winch and a second tongue portion, wherein the securing means is assemblable by releasably securing telescopic engagements between the first and second tongue portions and releasably securing the securing means to the frame means with one or more pins. Telescopic engagements between the pair of opposing side members and the plurality of crossbar members and between the support elements and the frame means, provide structure that enables adjustment of the spacing between, and relative height of, the shoe elements of the watercraft-seating means by virtue of the combined telescopic engagements and pin structure of the portable mooring device.

Each of the pair of opposing side members of the frame means includes a longitudinal member with a first end and a second end; and a plurality of width-adjustment members, each fixedly attached to and extending transversely inwardly from the longitudinal member toward the other longitudinal member of the pair of opposing side members and each having at least one bore therethrough, wherein a first one of the plurality of width-adjustment members is spaced near the first end of the longitudinal member, a second one of the plurality of width-adjustment members is spaced near the second end of the longitudinal member and a third one of the plurality of width-adjustment members is spaced between the first and second ones of the plurality of width adjustment members.

The frame means further includes each of the pair of opposing side members having a fourth width-adjustment member with at least one bore therethrough, the fourth width-adjustment member fixedly attached to and extending inwardly, either horizontally or at an upwardly directed angle, from the longitudinal member toward the other longitudinal member of the pair of opposing side members, and wherein the fourth width-adjustment member is spaced between the second one and the third one of the plurality of width-adjustment members. A reinforcing gusset is fixedly secured to each of the fourth width-adjustment members and the respective side member of the pair of opposing side members.

The frame means also includes a plurality of crossbar members wherein the ends of a first one of the plurality of crossbar members is telescopically engageable with the first ones of the plurality of width-adjustment members, the ends of a second one of the plurality of crossbar members is telescopically engageable with the second ones of the plurality of width-adjustment members, and the ends of a third one of the plurality of crossbar members is telescopically engageable with the third ones of the plurality of width-adjustment members, and wherein each of the plurality of crossbar members has at least one bore through each end thereof, the at least one bore being selectively alignable with the at least one bore of the respective width-adjustment members for receiving the pins therethrough.

The watercraft-seating means includes a pair of opposing supporting members, each having a first support element telescopically engageable with a respective one of the fourth width-adjustment members of the pair of opposing side members, the first support element having at least one bore therethrough that is selectively alignable with the at least one bore of the respective fourth width-adjustment member for releasably receiving a pin therethrough; a second support element fixedly attached to the first support element and extending generally upwardly from the first support element, the second support element having at least one bore through a distal end thereof; a third support element having a proximal end that is telescopically engageable with the second support element and having at least one bore therethrough that is selectively alignable with the at least one bore of the second support element for releasably receiving a pin therethrough, and a distal end; an optional support gusset fixedly secured to the first support element and to the second support element; and a shoe element pivotally mounted on the distal end of the third support element, wherein the pivotal mounting is off-center such that the shoe tends to slope downwardly toward the second crossbar member and wherein the shoe element has a planar upper surface covered with a non-abrasive cushioning material.

The securing means includes the tongue mechanism having a distal end, a proximal end with a pivot bore, a tongue-elevating bore, a platform mounted on the distal end, winch with a cable and hook mounted on the platform, and a platform gusset fixedly secured to the platform and the tongue mechanism; a first pair of brackets fixedly secured to the third one of the plurality of crossbar members and extending perpendicularly upwardly from the third crossbar member, the first pair of brackets being sufficiently spaced apart to receive the proximal end of the tongue mechanism therebetween, each of the first pair of brackets having a first bracket bore therethrough that is alignable with the pivot bore for releasably receiving a pin therethrough; and a second pair of brackets fixedly secured to the first one of the plurality of crossbar members and extending perpendicularly upwardly from the first crossbar member, the second pair of brackets being sufficiently spaced apart to receive the tongue mechanism therebetween, each of the second pair of brackets having a plurality of second bracket bores therethrough that are selectively alignable with the tongue-elevating bore for releasably receiving a pin therethrough.

The securing means further includes one or more cleats fixedly secured to undersides of the pair of opposing side members.

The portable mooring device is disassemblable by removing all pins used in the assembly thereof.

A method of mooring a small watercraft is also disclosed.

PRINCIPAL OBJECTS AND ADVANTAGES OF THE INVENTION

The principal objects and advantages of the present invention include: providing a portable mooring device for small watercraft; providing such a mooring device that is lightweight; providing such a mooring device that is adjustable in height, width and length for accommodating a wide range of small watercraft; providing such a mooring device that can be quickly and easily assembled and disassembled; providing such a mooring device that can be used in fresh water as well as salt water; providing such a mooring device that can be secured to a small watercraft and optionally secured to the bank of a waterway; providing such a mooring device that can be adjusted to a wide range of shoreline water depths; providing such a mooring device that prevents the bow of a watercraft being moored therewith from running aground; and generally providing such a mooring device that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

BRIEF DESCRIPTION OF THE DRAWING FIGURES

DETAILED DESCRIPTION OF THE PREFERRED EMBODIMENT

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Figure 1:
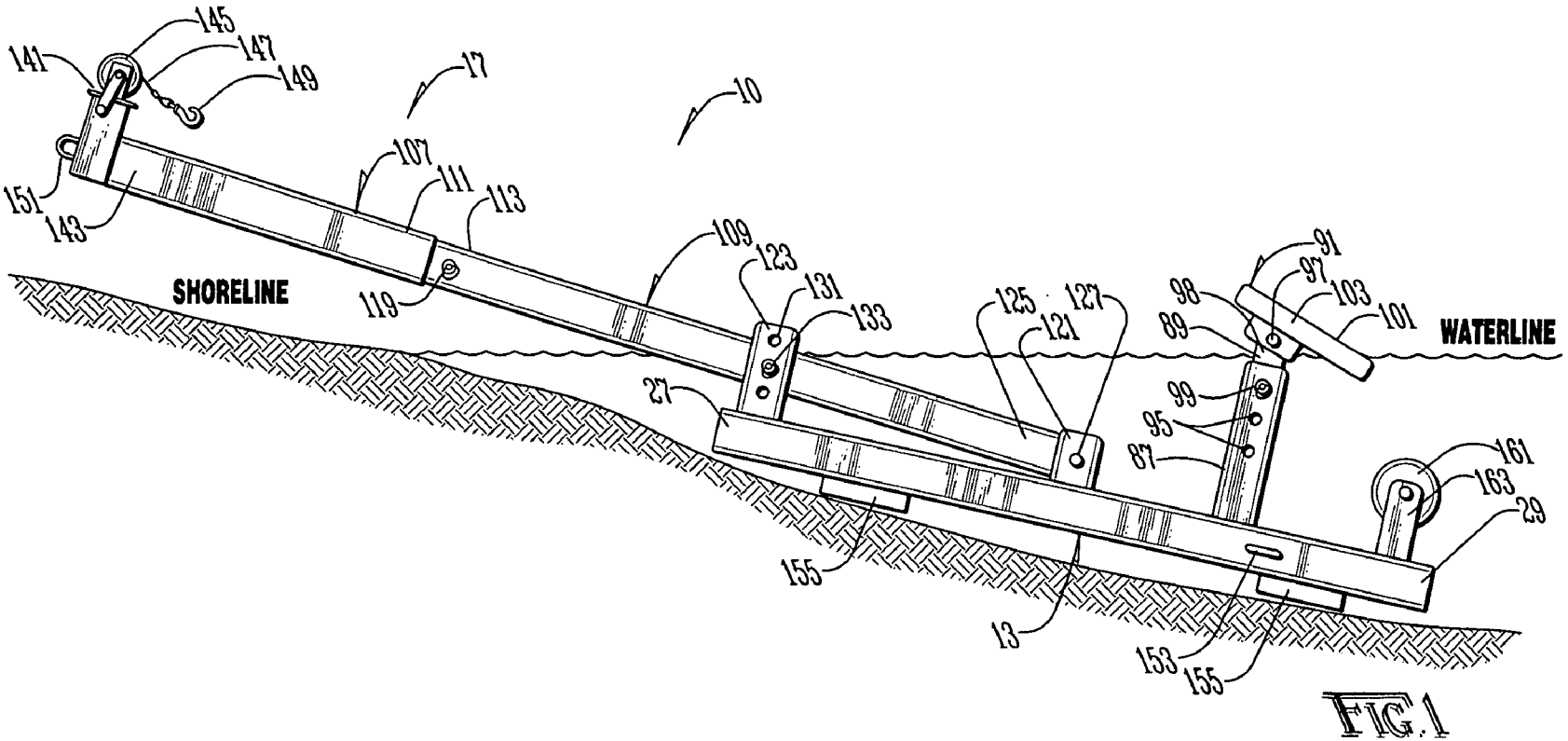
FIG. 1 is a side elevational view of a portable mooring device in use with a small watercraft, according to the present invention.

The reference numeral 10 generally refers to a portable mooring device for small watercraft in accordance with the present invention, as shown in FIGS. 1 through 5. FIG. 1 is a side elevational view showing the portable mooring device 10 of the present invention in an assembled configuration and deployed at the shoreline of a lake, river or other body of water. The portable mooring device 10 includes frame means 13, watercraft-seating means 15, and securing means 17.

Figure 2:
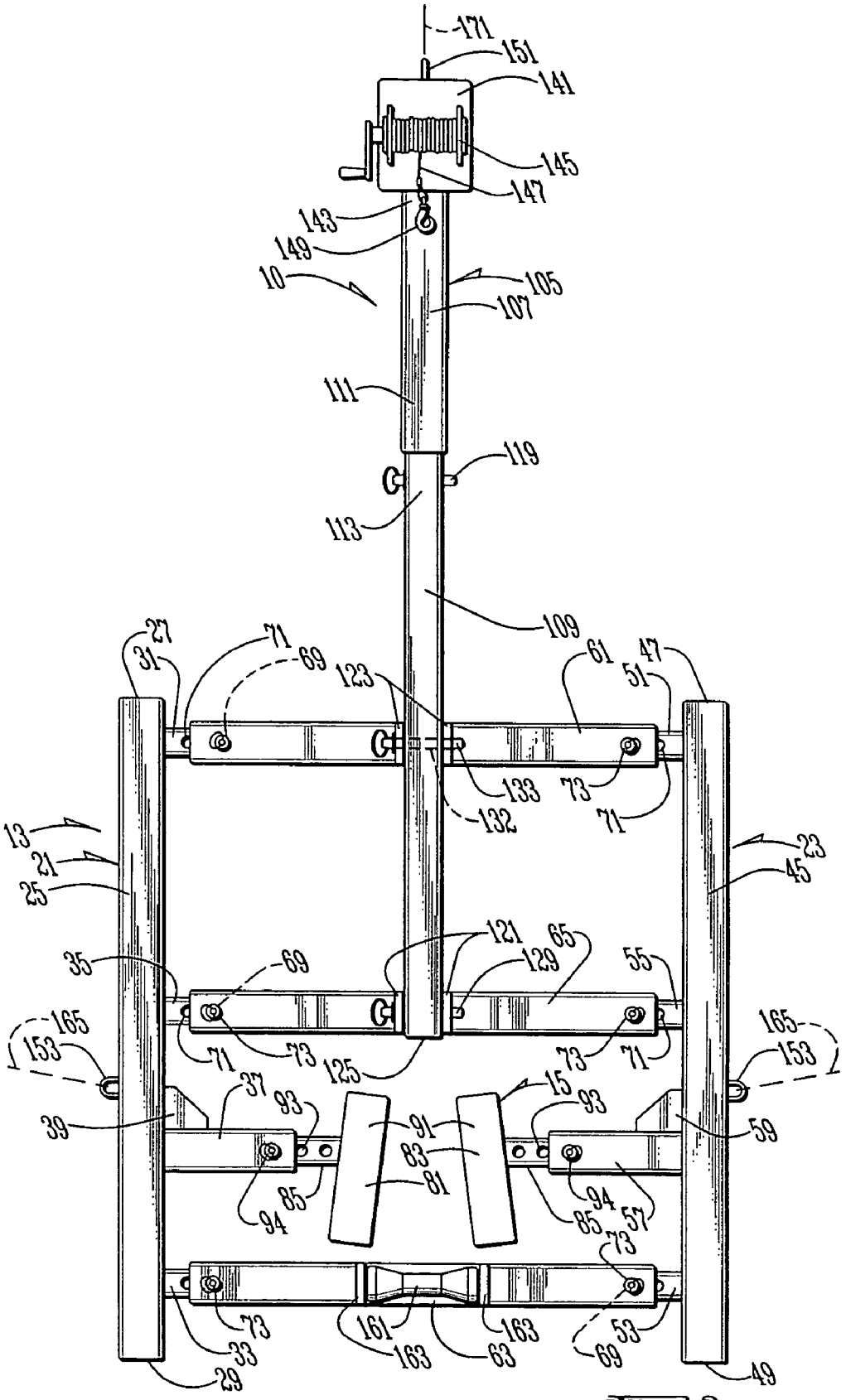
FIG. 2 is a top plan view of the portable mooring device for a small watercraft, according to the present invention.
Figure 3:
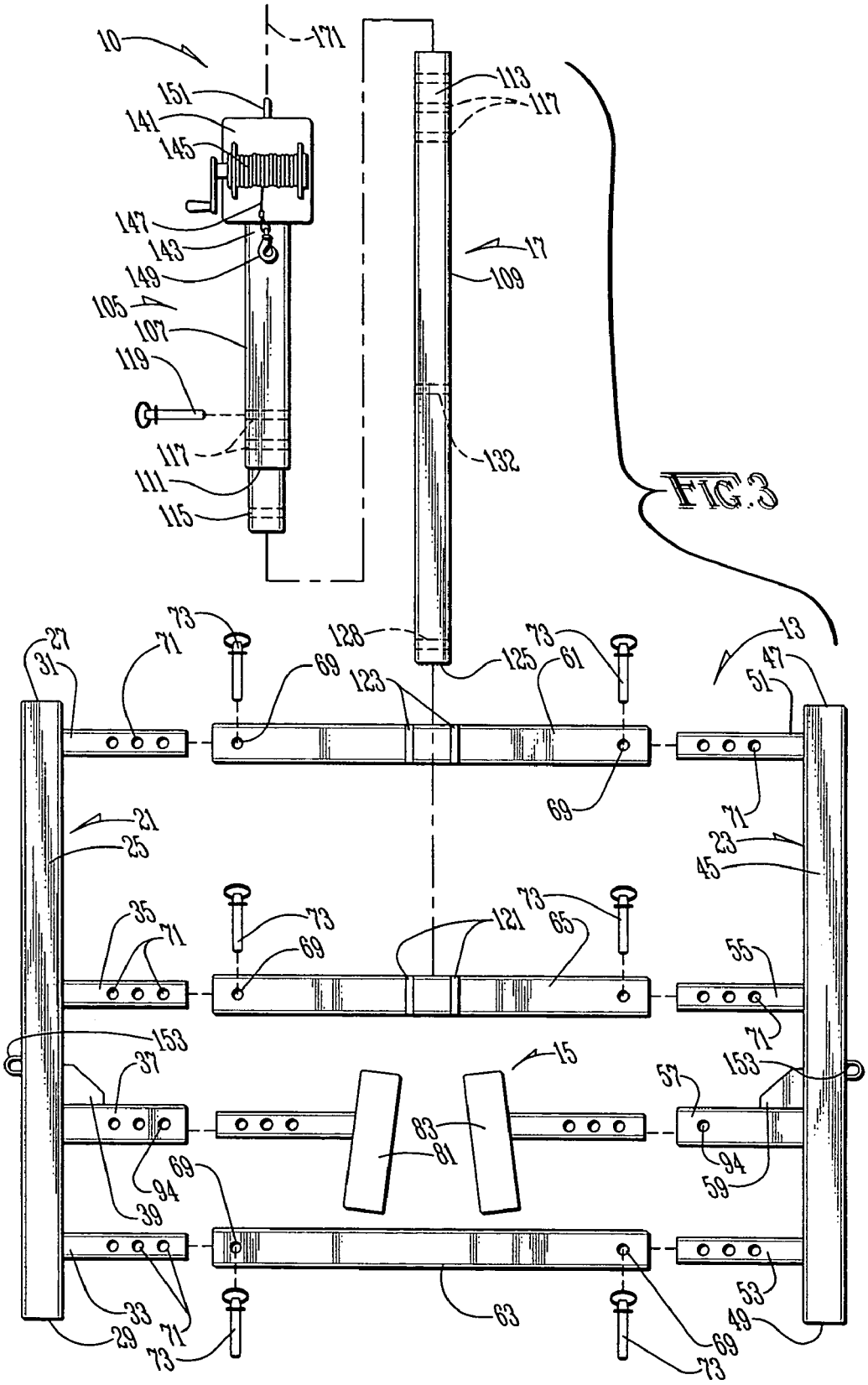
FIG. 3 is a reduced and exploded top plan view of the portable mooring device, according to the present invention.
Figure 4:
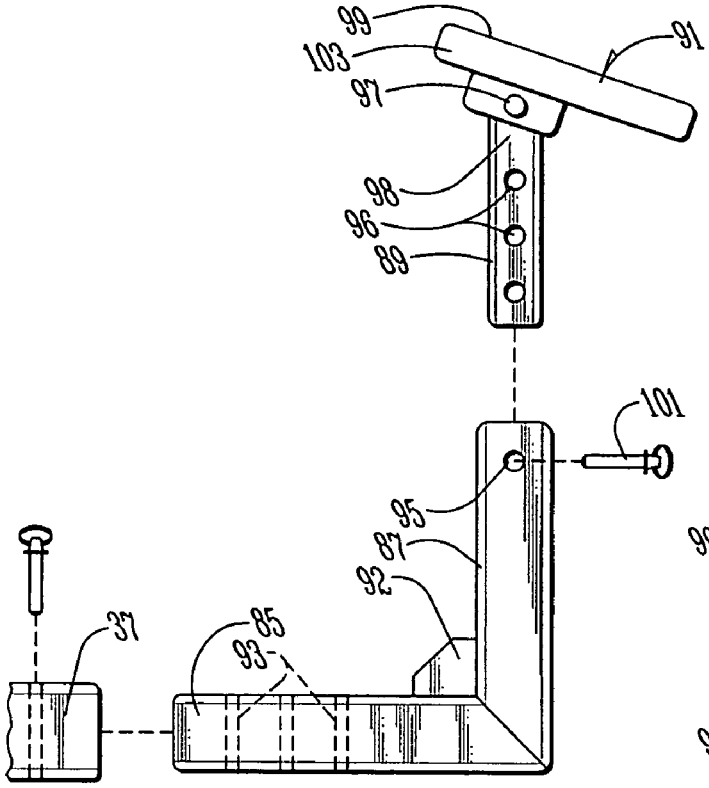
FIG. 4 is a reduced and exploded side elevational view of a portion of watercraft-seating means of the portable mooring device that extends horizontally from a width-adjustment member, according to the present invention.
Figure 5:
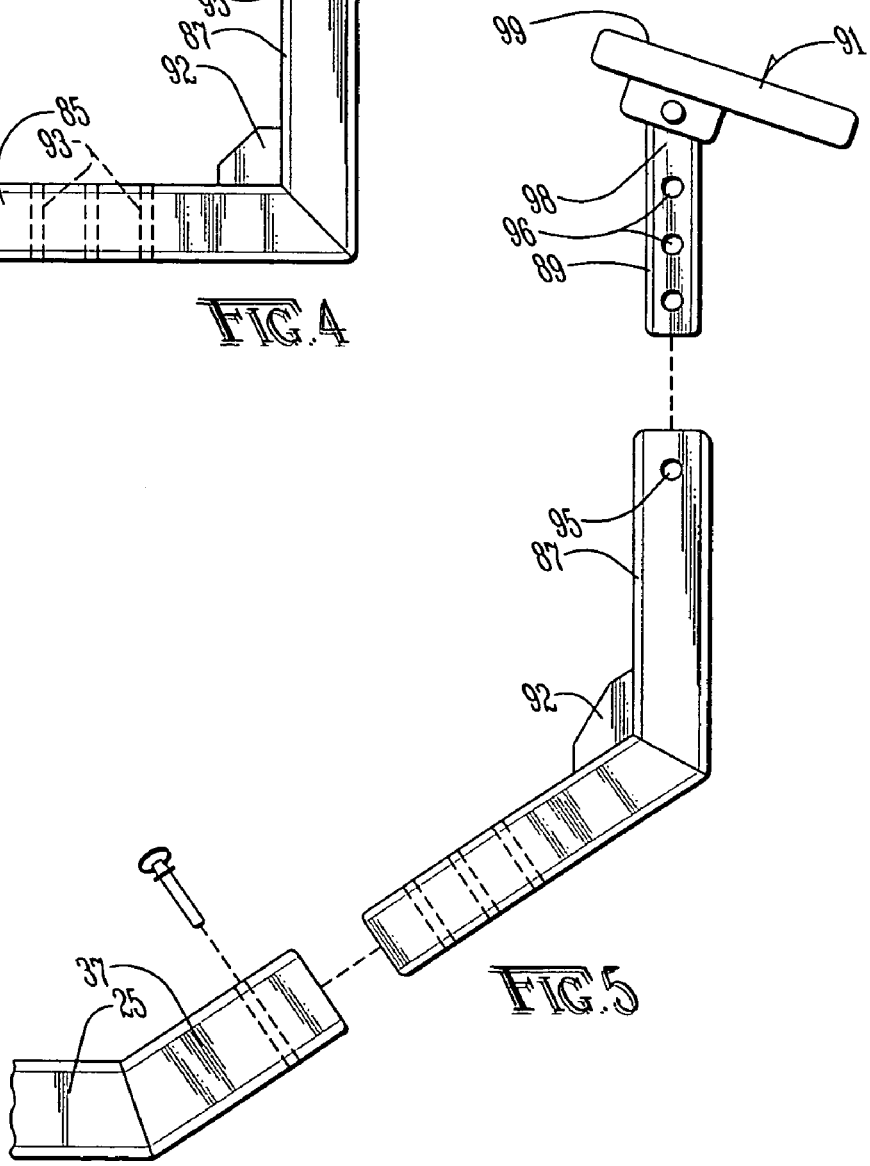
FIG. 5 is a reduced and exploded side elevational view of a modified version of the portion of the watercraft-seating means of the portable mooring device that extends at an upwardly directed angle from a width-adjustment member, according to the present invention.

The frame means 13 includes a pair of opposing side members 21, 23 as depicted in FIGS. 2 and 3. Side member 21 includes an elongate longitudinal member 25 with a first end 27 and a second end 29, a first width-adjustment member 31 fixedly attached to and extending transversely inwardly from the longitudinal member 25 toward side member 23 and wherein the first width-adjustment member 31 is spaced near first end 27, a second width-adjustment member 33 fixedly attached to and extending transversely inwardly from the longitudinal member 25 toward side member 23 and wherein the second width-adjustment member 33 is spaced near second end 29, a third width-adjustment member 35 fixedly attached to and extending inwardly from the longitudinal member 25 toward side member 23 wherein the third width-adjustment member 35 is spaced between the first width-adjustment member 31 and the second width-adjustment member 33; and a fourth width-adjustment member 37 fixedly attached to and extending inwardly, either horizontally or at an upwardly directed angle, from the longitudinal member 25 toward side member 23 wherein the fourth width-adjustment member 37 is spaced between the second width-adjustment member 33 and the third width-adjustment member 35. A reinforcing gusset 39 fixedly secures the fourth width-adjustment member 37 to the longitudinal member 25.

Similarly, side member 23 includes an elongate longitudinal member 45 having a first end 47 and a second end 49, a first width-adjustment member 51 fixedly attached to and extending transversely inwardly from the longitudinal member 45 toward side member 21 and wherein the first width-adjustment member 51 is spaced near first end 47, a second width-adjustment member 53 fixedly attached to and extending transversely inwardly from the longitudinal member 45 toward side member 21 and wherein the second width-adjustment member 53 is spaced near second end 49, a third width-adjustment member 55 fixedly attached to and extending transversely inwardly from the longitudinal member 45 toward side member 21 wherein the third width-adjustment member 55 is spaced between the first width-adjustment member 51 and the second width-adjustment member 53; and a fourth width-adjustment member 57 fixedly attached to and extending inwardly, either horizontally or at an upwardly directed angle, from longitudinal member 45 toward side member 21 wherein the fourth width-adjustment member 57 is spaced between the second width-adjustment member 53 and the third width-adjustment member 55. A reinforcing gusset 59 fixedly secures the fourth width-adjustment member 57 to the longitudinal member 45.

The frame means 13 also includes a first crossbar member 61 that, in use, extends between the first width-adjustment member 31 and the first width-adjustment member 51; a second crossbar member 63 that, in use, extends between the second width-adjustment member 33 and the second width-adjustment member 53; and a third crossbar member 65 that, in use, extends between the third width-adjustment member 35 and the third width-adjustment member 55.

Preferably, each of the longitudinal members 25, 45 and each of the width-adjustment members 31–37, 51–57 are constructed of square-shaped, similarly dimensioned tubing. Also preferably, the crossbar members 61–65 are constructed of square-shaped tubing wherein the ends of the first crossbar member 61 are slidably and telescopically engageable with the first width-adjustment members 31, 51; the ends of the second crossbar member 63 are slidably and telescopically engageable with the second width-adjustment members 33, 53; and the ends of the third crossbar member 65 are slidably and telescopically engageable with the third width-adjustment members 35, 55. It is to be understood that the telescopically engageable members may be dimensioned wherein either the width-adjustment members may be insertable into the crossbar members or, alternatively, the crossbar members may be insertable into the width-adjustment members.

Although square-shaped tubing is the preferred cross-sectional profile of many of the components of the portable mooring device 10 as described herein, it is to be understood that the tubing may have a circular cross-section, or any other suitable cross-sectional profile, as desired.

Each end of each of the crossbar members 61–65 has at least one bore 69 therethrough. In addition, each of the width-adjustment members 31–35, 51–55 has at least one bore 71 therethrough that can be selectively aligned with the at least one bore 69 of respective crossbar members 61–65. When the longitudinal members 25, 45 are spaced apart from each other in a parallel manner such that the at least one bore 69 in each end of the first crossbar member 61 are aligned with the at least one bore 71 of the first width-adjustment members 31, 51, corresponding bores 69 in each end of the second and third crossbar members 63, 65 are similarly aligned with corresponding bores 71 of the second and third width-adjustment members 33–35, 5–55. Pins 73 inserted through those corresponding aligned bores 69, 71 through the crossbar members 61–65 and width-adjustment members 31–35, 51–55 releasably fix the spacing between the longitudinal members 25, 45. Preferably, pins as disclosed herein, such as pins 73, are quick-release pins, such as detent pins as provided by Carr Lane Manufacturing Co., St. Louis, Mo.. However, it is to be understood that such pins may be pins with cotter keys, or any other suitable fastening means. It is also to be understood that the pins and the bores associated therewith may be vertically-oriented or horizontally-oriented, depending on the structure of the portable mooring device 10.

The watercraft-seating means 15 of the portable mooring device 10 includes a first supporting member 81 and a second supporting member 83, each of which includes a first support element 85, a second support element 87, a third support element 89, and a receiver or shoe element 91. Each first support element 85 is constructed of square-shaped tubing and dimensioned such that the first support element 85 is slidably and telescopically engageable with the respective fourth width-adjustment member 37, 57. Again and elsewhere herein, it is to be understood that the ends of telescopically engageable parts of the portable mooring device 10 may be dimensioned wherein either the first support elements 85 are insertable into the fourth width-adjustment members 37, 57 or, alternatively, the fourth width-adjustment members 37, 57 may be insertable into the first support elements 85.

Each first support element 85 has at least one bore 93 therethrough. In addition, each of the fourth width-adjustment members 37, 57 has at least one bore 94 therethrough, which can be aligned with the respective at least one bore 93.

Preferably, the second support elements 87 are constructed of square-shaped tubing generally dimensioned similarly to that of the first support elements 85. Each second support element 87 is fixedly attached to a respective one of the first support elements 85 such that, in use, the second support element 87 extends generally upwardly from the first support element 85. Each second support element 87 has at least one bore 95 therethrough. An optional support gusset 92 may be fixedly secured to the first support element 85 and to the second support element 87.

Preferably, the third support elements 89 are constructed of square-shaped tubing and dimensioned such that the third support elements 89 are slidably and telescopically engageable with the respective second support element 87. Each third support element 89 has at least one bore 96 therethrough. Each shoe element 91 is mounted by a pivot connection 97 to distal end 98 of a respective third support element 89 wherein the pivotal mounting is off-center such that a planar upper surface 99 of each shoe element 91 tends to slope downwardly toward the second crossbar element 63.

Pins 101 inserted through corresponding aligned bores 95, 96 of the respective second and third support elements 87, 89 releasably fix the spacing of the respective shoe elements 91 above the first support elements 37, 57. The upper surface 99 of each shoe element 91 is preferably constructed of wood and covered with a non-abrasive cushioning material 103, such as a piece of carpet, or other suitable material.

The securing means 17 of the portable mooring device 10 includes a tongue mechanism 105 having a first tongue portion 107 and a second tongue portion 109, each preferably constructed of square-shaped tubing and structured such that an end 111 of the first tongue portion 107 is slidably and telescopically engageable with an end 113 of the second tongue portion 109. For example, one of the first or second tongue portions 107, 109 may be dimensioned smaller than the other such that either the first or second tongue portion 107, 109 is insertable into the other; alternatively, the first and second tongue portions 107, 109 may be similarly dimensioned with a short piece of smaller-dimensioned tubing 115 being insertable into ends 111, 113 of the first and second tongue portions 107, 109, or fixedly secured to one of the first or second tongue portions 107, 109 and removably insertable into the other first or second tongue portion 107, 109, as shown in FIG. 3.

Each of the ends 111, 113 of the first and second tongue portions 107, 109 has a bore 117 therethrough wherein a pin 119 can be inserted through the bores 117 of the ends 111, 113 to releasably secure the first and second tongue portions 107, 109 together in an end-to-end relationship.

The securing means 17 also includes a first pair of brackets 121 and a second pair of brackets 123. The first pair of brackets 121 are fixedly secured to the third crossbar member 65 wherein the first pair of brackets 121 extend perpendicularly upwardly from the third crossbar member 65. The first pair of brackets 121 are sufficiently spaced apart to receive proximal end 125 of the tongue mechanism 105 between the first pair of brackets 121. Each of the first pair of brackets 121 has bores 127 and proximal end 125 has a corresponding pivot bore 128 therethrough wherein a pin 129 inserted through bores 127 and pivot bore 128 pivotally connects proximal end 125 of the tongue mechanism 105 to the first pair of brackets 121 such that, in use, tongue mechanism 105 is pivotable in a vertical plane.

The second pair of brackets 123 are fixedly secured to the first crossbar member 61 wherein the second pair of brackets 123 extend perpendicularly upwardly from the first crossbar member 61. The second pair of brackets 123 are sufficiently spaced apart to receive the tongue mechanism 105 between the second pair of brackets 123. Each of the second pair of brackets 123 includes a plurality of bores 131 therethrough, as shown in FIG. 1, and the tongue mechanism 105 has a corresponding tongue-elevating bore 132 therethrough such that, in use, a pin 133 inserted through a selected one of the plurality of bores 131 and through the corresponding tongue-elevating bore 132 of the tongue mechanism 105 releasably fixes the tongue mechanism 105 at an upwardly directed angle from a plane defined by the pair of opposing side members 21, 23 as needed to appropriately accommodate a watercraft to be moored on the portable mooring device 10 as described herein.

The tongue mechanism 105 also includes a platform 141 mounted on distal end 143 of the tongue mechanism 105 with a winch 145, having a cable 147 and hook 149, mounted on the platform 141. A platform gusset 150 is fixedly secured to the platform 141 and to the tongue mechanism 105, as shown in FIG. 1. An eye-hook 151 is fixedly secured to the distal end 143 of the tongue mechanism 105 for use with a tie strap, rope or cable to secure the portable mooring device 10 to a land object, such as a tree, driven stake, or other suitable anchor. The portable mooring device 10 also includes an opposing pair of eye hooks 153 located on opposite sides of the pair of opposing side members 21, 23 for securing a watercraft to the portable mooring device 10 and, additionally, for laterally securing the portable mooring device 10 to one or more land objects. One or more cleats 155 are fixedly secured to the undersides of the pair of opposing side members 21, 23 to provide additional stability for the portable mooring device 10 when in use with a watercraft seated thereon.

If desired, the portable mooring device 10 may optionally include a keel roller 161 rotationally mounted on a third pair of brackets 163 fixedly mounted on, and extending vertically upward from, the second crossbar member 63, as shown in FIGS. 1 and 2. For many applications of the portable mooring device 10, however, such a keel roller 161 may be unnecessary.

Preferably, the frame means 13 of the portable mooring device 10 is constructed of aluminum tubing, or other suitable lightweight material; and the pins and other metallic parts are constructed of stainless steel or other suitable corrosion-resistant material.

In an application of the present invention, an area is selected along a waterway which is suitable for mooring a watercraft with the portable mooring device 10. The pair of opposing side members 21, 23 are laid in parallel fashion on the bank of the waterway with second ends 29, 49 directed toward the waterway. The ends of the first, second and third crossbar members 61–65 are appropriately telescopically engaged with the first, second and third width-adjustment members 31–35, 51–55 and secured thereto with six pins 73. Those same six pins 73 can be removed and reinserted as the spacing between the pair of opposing side members 21, 23 is adjusted to accommodate the watercraft to be moored on the portable mooring device 10.

Then, the first and second supporting members 81,83 of the watercraft-seating means are assembled by securing each of the third support elements 89 to a respective second support element 87 with one of the pins 101, and securing each of the first support elements 85 to a respective fourth width-adjustment member 37, 57 with one of the pins. The first support members 81 are adjusted inwardly and outwardly relative to the fourth width-adjustment members 37, 57 to further adjust the spacing between the shoe elements 91 as needed to accommodate the watercraft to be moored on the portable mooring device 10. Further, the third support elements 89 are adjusted upwardly and downwardly relative to the respective fourth width-adjustment members 37, 57 and second support elements 87, as needed, to compensate for the slope of the bottom profile of the waterway where the watercraft is to be moored on the portable mooring device 10.

The first tongue portion 107 is then connected to the second tongue portion 109 with pin 119, and proximal end 125 of the tongue mechanism 105 is connected to the first pair of brackets 121 with pin 129. Finally, the tongue mechanism 105 is pivoted about pin 129 by manually raising distal end 143 of the tongue mechanism 105 as needed to elevate the winch 145 to an appropriate height for appropriately accommodating the watercraft to be moored on the portable mooring device 10.

With the portable mooring device 10 now being fully assembled, the device 10 is physically shoved longitudinally toward and into the edge of the waterway. Downward pressure may be exerted on the distal end 143 of the tongue mechanism 105 to minimize the frictional resistance encountered while displacing the portable mooring device 10 into the edge of the waterway. For some applications, proper placement of the shoe elements 91 for seating the watercraft on the portable mooring device 10 may require that the shoe elements 91 be positioned above or at the water level of the waterway. For other applications, proper placement may require that the shoe elements 91 be positioned below the water level of the waterway.

When the watercraft has been positioned where it is in contact with, and approximately centered between, the shoe elements 91, the cable 147 is trained out of the winch 145 and the hook 149 is secured to a loop connector that is located on the bow of substantially all small watercraft. The winch 145 is then used to pull the watercraft firmly against or partially onto the shoe elements 91 wherein the triangulation arrangement between the two shoe elements 91 and the winch 145 securely positions the orientation of the watercraft being moored relative to the portable mooring device 10; in other words, seating the watercraft on the portable mooring device 10. Tie straps, ropes or cables 165 connected to the eye-hooks 153 may be used to secure the watercraft being moored to the portable mooring device 10 and to laterally secure the portable mooring device 10 to land objects located on opposing sides of the portable mooring device 10. Additional security may be realized by securing the portable mooring device 10 to a land object located in front of the portable mooring device 10 by means of a tie strap, rope or cable connected to the eye-hook 151 as indicated by the dashed line designated by numeral 171.

Not to be overlooked is the substantial stability provided by the portable mooring device 10 due to the sidewise expanse of the pair of opposing side members 21, 23 by virtue of the interconnecting first, second and third crossbar members 61–65, wherein the pair of opposing side members perform a function not unlike that provided by outriggers.

When it is time to break camp and a mooring is no longer needed, the watercraft is backed off the portable mooring device 10 with the procedure of disassembling the portable mooring device 10 being basically the reverse of the assembly of the portable mooring device 10 as hereinbefore described. Simply stated, disassembly is substantially accomplished by removing all of the pins. Typically, the longest component of the disassembled portable mooring device 10 is only approximately forty-four inches in length. All pieces of the disassembled portable mooring device 10 can be stored in a canvas duffle-type storage bag measuring approximately twelve inches by twelve inches by forty-four inches. The storage bag and all components of the disassembled portable mooring device 10 typically weighs only approximately fifty pounds or less and is sufficiently compact and lightweight to be transported in the trunk of a vehicle or in the watercraft itself.

Summarizing, the present invention provides an easily assemblable and disassemblable, lightweight, portable mooring device that is sufficiently adjustable to accommodate a majority of all small watercraft and is simple enough to be usable by even the most inexperienced and novice boaters. The frame of the portable mooring device is constructed of aluminum tubing or other suitable lightweight material and has an adjustable rectangular shape with two telescopingly mounted shoe elements for receiving the bow of a watercraft to be moored. The portable mooring device has a tongue mechanism, extendable in length, that protrudes from the end opposite to the shoe elements. The tongue has a winch mounted thereon to assist with firmly seating the watercraft on the mooring device and prevents unintended separation of the watercraft from the mooring device. A plurality of eye-hooks at the end and sides provide means for securing the mooring device to land objects. The portable mooring device is adjustable by extending the shoe elements in height and by extending the frame in width. By being adjustable in height, width and length, the portable mooring device can be used with a wide variety of small boats, including without limitation V-hull, flat bottom and tri-hull boats. The telescopingly mounted padded shoe elements pivot from side to side and up and down to accept and adapt to the hull of the watercraft being moored. The portable mooring device is releasably pinned together at several points which allows the portable mooring device to be easily assembled and disassembled for ease of portability and storage. The portable mooring device can be assembled or disassembled in approximately two minutes. When disassembled, the maximum length of any of the pieces thereof is approximately forty-four inches with the total composite weight thereof in a canvas carrying bag being approximately fifty pounds, or less.

It is also to be understood that while certain forms of the present invention have been illustrated and described herein, it is not to be limited to the specific forms or arrangement of parts as described and shown.

What is claimed is:

1. A portable mooring device for a small watercraft, comprising:

(a) a plurality of detent pins;

(b) frame means including a pair of opposing side members and a plurality of crossbar members wherein the frame means is assemblable by releasably securing telescopic engagements between the crossbar members and the pair of opposing side members with one or more of the plurality of detent pins;

(c) watercraft-seating means including shoe and support elements wherein the watercraft-seating means is assemblable by releasably securing telescopic engagements between the support elements and between the watercraft-seating means and the frame means with one or more of the plurality of detent pins; and (d) securing means including a tongue mechanism having a first tongue portion with a winch and a second tongue portion, wherein the securing means is assemblable by releasably securing telescopic engagements between the first and second tongue portions and releasably securing the tongue mechanism to the frame means with one or more of the plurality of detent pins; and (e) wherein telescopic engagements between the pair of opposing side members and the plurality of crossbar members, and between the support elements and the frame means, provide structure that enables adjustment of the spacing between the shoe elements of the watercraft-seating means by virtue of the combined telescopic engagements and pin structure thereof.

2. A portable mooring device as described in claim 1, wherein the telescopic engagements and pin structure between the support elements enable adjustment of the height of the shoe elements relative to a plane defined by the pair of opposing side members.

3. The portable mooring device as described in claim 1, wherein the frame means includes:

(a) each of the pair of opposing side members having:

(1) a longitudinal member with a first end and a second end, and (2) a plurality of width-adjustment members, each being fixedly attached to and extending transversely inwardly from the longitudinal member toward the other side member of the pair of opposing side members and each having at least one bore therethrough, wherein a first one of the plurality of width-adjustment members is spaced near the first end of the longitudinal member, a second one of the plurality of width-adjustment members is spaced near the second end of the longitudinal member, and a third one of the plurality of width-adjustment members is spaced between the first and second ones of the plurality of width adjustment members; and (b) wherein the ends of a first one of the plurality of crossbar members is telescopically engageable with the first ones of the plurality of width-adjustment members, the ends of a second one of the plurality of crossbar members is telescopically engageable with the second ones of the plurality of width-adjustment members, and the ends of a third one of the plurality of crossbar members is telescopically engageable with the third ones of the plurality of width-adjustment members, and wherein each of the plurality of crossbar members has at least one bore through each end thereof, the at least one bore being selectively alignable with the at least one bore of the respective width-adjustment member for receiving one of the plurality of pins therethrough.

4. The portable mooring device as described in claim 3, wherein the frame means further includes each of the pair of opposing side members having a fourth width-adjustment member with at least one bore therethrough, the fourth width-adjustment member being fixedly attached to and extending inwardly, either horizontally or at an upwardly directed angle, from the longitudinal member toward the other side member of the pair of opposing side members, and wherein the fourth width-adjustment member is spaced between the second one and the third one of the plurality width-adjustment members.

5. The portable mooring device as described in claim 4, wherein the watercraft seating means includes a pair of opposing supporting members, each having:

(a) a first said support element telescopically engageable with a respective fourth width-adjustment member of the pair of opposing side members such that the first said support member extends either horizontally or at an upwardly directed angle toward the other supporting member of the pair of opposing supporting members, the first said support element having at least one bore therethrough that is selectively alignable with the at least one bore of the respective fourth width-adjustment member, (b) a second said support element fixedly attached to the first said support element and extending upwardly from the first said support element, the second said support element having at least one bore through a distal end thereof, (c) a third said support element having a proximal end that is telescopically engageable with the second said support element and having at least one bore therethrough that is selectively alignable with the at least one bore of the second said support element for receiving one of the plurality of pins therethrough, and a distal end; and (d) a shoe element pivotally mounted on the distal end of the third said support element and having a planar upper surface covered with a non-abrasive cushioning material, the pivotal mounting being off-center such that the upper surface tends to slope downwardly toward the second crossbar element.

6. The portable mooring device as described in claim 3, wherein the securing means includes:

(a) the tongue mechanism having a tongue-elevating bore therethrough, a proximal end with a pivot bore therethrough, a distal end, a platform mounted on the distal end, and a winch with a cable and hook mounted on the platform;

(b) a first pair of brackets fixedly secured to the third one of the plurality of crossbar members and extending perpendicularly upwardly from the third crossbar member, the first pair of brackets being sufficiently spaced apart to receive the proximal end of the tongue mechanism therebetween, each of the first pair of brackets having a first bracket bore therethrough that is alignable with the pivot bore of the proximal end of the tongue mechanism for receiving one of the plurality of pins therethrough; and (c) a second pair of brackets fixedly secured to the first one of the plurality of crossbar members and extending perpendicularly upwardly from the first crossbar member, the second pair of brackets being sufficiently spaced apart to receive the tongue mechanism therebetween, each of the second pair of brackets having a plurality of second bracket bores therethrough that are selectively alignable with the tongue-elevating bore of the tongue mechanism for receiving one of the plurality of pins therethrough.

7. The portable mooring device as described in claim 6, wherein the securing means further includes an eye-hook mounted on the distal end of the tongue mechanism.

8. The portable mooring device as described in claim 1, wherein the securing means further includes an opposing pair of eye-hooks mounted on opposite sides of the pair of opposing side members.

9. The portable mooring device as described in claim 1, wherein the securing means further includes one or more cleats fixedly secured to undersides of the pair of opposing side members.

10. A portable mooring device for a small watercraft, comprising:

(a) a plurality of detent pins;

(b) frame means including:

(1) a pair of opposing side members, each having:

(A) an elongate longitudinal member with a first end and a second end, the longitudinal member being constructed of square-shaped tubing, (B) a first width-adjustment member having at least one bore therethrough, the first width-adjustment member fixedly attached to and extending transversely inwardly from the longitudinal member toward the other side member of the pair of opposing side members, the first width-adjustment member being spaced near the first end of the longitudinal member and constructed of square-shaped tubing dimensioned similarly to the square-shaped tubing of the longitudinal member, (C) a second width-adjustment member having at least one bore therethrough, the second width-adjustment member fixedly attached to and extending transversely inwardly from the longitudinal member toward the other side member of the pair of opposing side members, the second width-adjustment member being spaced near the second end of the longitudinal member and constructed of square-shaped tubing dimensioned similarly to the square-shaped tubing of the longitudinal member, (D) a third width-adjustment member having at least one bore therethrough, the third width-adjustment member fixedly attached to and extending transversely inwardly from the longitudinal member toward the other side member of the pair of opposing side members, the third width-adjustment member being spaced between the first width-adjustment member and the second width-adjustment member and constructed of square-shaped tubing dimensioned similarly to the square-shaped tubing of the longitudinal member, and (E) a fourth width-adjustment member having at least one bore therethrough, the fourth width-adjustment member fixedly attached to and extending inwardly, either horizontally or at an upwardly directed angle, from the longitudinal member toward the other side member of the pair of opposing side members, the fourth width-adjustment member being spaced between the second width-adjustment member and the third width-adjustment member and constructed of square-shaped tubing dimensioned similarly to the square-shaped tubing of the longitudinal member, the fourth width-adjustment member including a reinforcing gusset fixedly secured to the fourth width-adjustment member and the respective side member of the pair of opposing side members;

(2) a first crossbar member extending between the first width-adjustment members of the pair of opposing side members, wherein the first crossbar member is constructed of square-shaped tubing dimensioned such that the first crossbar member is slidably and telescopically engageable with the first width-adjustment members and wherein each end of the first crossbar member has at least one bore therethrough that is selectively alignable with the at least one bore of the respective first width-adjustment members;

(3) a second crossbar member extending between the second width-adjustment members of the pair of opposing side members, wherein the second crossbar member is constructed of square-shaped tubing dimensioned such that the second crossbar member is slidably and telescopically engageable with the second width-adjustment members and wherein each end of the second crossbar member has at least one bore therethrough that is selectively alignable with the at least one bore of the respective second width-adjustment members;

(4) a third crossbar member extending between the third width-adjustment members of the pair of opposing side members, wherein the third crossbar member is constructed of square-shaped tubing dimensioned such that the third crossbar member is slidably and telescopically engageable with the third width-adjustment members and wherein each end of the third crossbar member has at least one of bore therethrough that is selectively alignable with the at least one bore of the respective third width-adjustment members; and (5) a plurality of the detent pins that are insertable through selectively aligned bores of the first crossbar member and the first width-adjustment members, selectively aligned bores of the second crossbar member and the second width-adjustment members, and selectively aligned bores of the third crossbar member and the third width-adjustment members to thereby releasably fix the spacing between the pair of opposing side members;

(c) watercraft-seating means including a pair of opposing supporting members, each having:

(1) a first support element constructed of square-shaped tubing dimensioned to be slidably and telescopically engageable with the square-shaped tubing of a respective fourth width-adjustment members, wherein the first support element has at least one bore therethrough that is selectively alignable with the at least one bore of the respective fourth width-adjustment member, and wherein one of the plurality of detent pins is insertable through the at least one bore of the fourth width-adjustment member that is selectively aligned with the at least one bore of the first support element to thereby releasably fix the spacing of the shoe element relative to the fourth width-adjustment member, (2) a second support element constructed of square-shaped tubing dimensioned similarly to the square-shaped tubing of the first support element, the second support element being fixedly attached to the first support element and extending generally upwardly from the first support element, the second support element having at least one bore therethrough, (3) a third support element having a distal end and a proximal end, constructed of square-shaped tubing dimensioned such that the third support element is slidably and telescopically engageable with the second support element and having at least one bore therethrough that is selectively alignable with the at least one bore of the second support element, wherein one of the plurality of detent pins is insertable through the at least one bore of the second support element that is selectively aligned with the at least one bore of the third support element to thereby releasably fix the spacing of the shoe element relative to the first support element; and (4) a shoe element pivotally mounted on the distal end of the third support element and having a planar upper surface covered with a non-abrasive cushioning material, the pivotal mounting being off-center such that the upper surface tends to slope downwardly toward the second crossbar element, and (d) securing means including:

(1) a tongue mechanism having a distal end, a proximal end with a pivot bore therethrough, and a tongue-elevating bore, the tongue mechanism including:

(A) first and second tongue portions, each constructed of square-shaped tubing and structured such that an end of the first tongue portion is slidably and telescopically engageable with an end of the second tongue portion, each of the telescopically engageable ends of the first and second tongue portions having a bore therethrough wherein one of the plurality of detent pins is insertable through the bores of the telescopically engageable ends of the first and second tongue portions to thereby releasably secure the first and second tongue portions in an end-to-end relationship, (B) a platform mounted on the distal end of the tongue mechanism, the platform including a platform gusset fixedly secured between the platform and the tongue mechanism, and (C) a winch with a cable and hook mounted on the platform;

(2) a first pair of brackets fixedly secured to the third crossbar member and extending perpendicularly upwardly from the third crossbar member, the first pair of brackets being sufficiently spaced apart to receive the proximal end of the tongue mechanism therebetween, each of the first pair of brackets having a first bracket bore therethrough wherein one of the plurality of detent pins is insertable through the first bracket bores of the first pair of brackets and through the pivot bore of the proximal end of the tongue mechanism to thereby pivotally connect the tongue mechanism to the first pair of brackets such that the tongue mechanism is pivotally movable in a vertical plane;

(3) a second pair of brackets fixedly secured to the first crossbar member and extending perpendicularly upwardly from the first crossbar member, the second pair of brackets being sufficiently spaced apart to receive the tongue mechanism therebetween, each of the second pair of brackets having a plurality of second bracket bores therethrough wherein one of the plurality of detent pins is insertable through the tongue-elevating bore of the tongue mechanism and through a selected pair of the second bracket bores to thereby releasably fix the tongue mechanism at a desired angle relative to a plane defined by the pair of opposing side members;

(4) an eye-hook mounted on the distal end of the tongue mechanism;

(5) an opposing pair of eye hooks mounted on opposite sides of the pair of opposing side members; and (6) one or more cleats fixedly secured to undersides of the pair of opposing side members.

11. A method for temporarily mooring a small watercraft along the edge of a waterway, the method comprising the steps of:

(a) providing a portable mooring means having (1) frame means including a pair of opposing side members and a plurality of crossbar members, (2) watercraft-seating means including shoe and support elements, (3) securing means including eye-hooks and a tongue mechanism, comprising first and second tongue portions wherein one of the tongue portions includes a winch, (4) a plurality of pins, and (5) at least one tie strap, rope or cable;

(b) assembling the frame means by releasably securing the crossbar members to the pair of opposing side members with the pins;

(c) assembling the watercraft-seating means by releasably securing the shoe elements to the support elements with the pins and releasably securing the watercraft-seating means to the frame means with the pins;

(d) assembling the securing means by releasably securing the first and second tongue portions together and to the frame means with the pins;

(e) adjusting the height of, and spacing between, the shoe elements and adjusting the location of the winch to accommodate a watercraft to be moored;

(f) placing the assembled portable mooring means in the edge of the waterway;

(g) seating the watercraft on the portable mooring means with the winch; and (h) securing the watercraft to the portable mooring means and to land objects with the eye-hooks and the at least one tie strap, rope or cable.

12. The method for temporarily mooring a small watercraft as described in claim 11, further including the steps of:

(a) removing the watercraft from the portable mooring means; and (b) disassembling the portable mooring means by removing all of the pins.

* * * * *